United States Patent [19]

Batson et al.

[11] 4,307,651

[45] Dec. 29, 1981

[54] ROCKET IN-TUBE SPIN DEVICE AND REAR SABOT

[75] Inventors: James L. Batson; David L. Booker, both of Huntsville, Ala.

[73] Assignee: The United States of America as represented by the Secretary of the Army, Washington, D.C.

[21] Appl. No.: 72,274

[22] Filed: Sep. 4, 1979

[51] Int. Cl.[3] ..... F41F 3/04

[52] U.S. Cl. ..... 89/1.808; 102/522; 244/3.23

[58] Field of Search ..... 102/93; 244/3.23; 89/1.808, 1.816, 1.819, 14 SB

[56] References Cited

U.S. PATENT DOCUMENTS

| | | | |
|---|---|---|---|
| 2,835,170 | 5/1958 | Kindelberger | 89/1.808 |
| 2,968,245 | 1/1961 | Sutton | 244/3.23 |
| 3,009,393 | 11/1961 | Lynch | 89/1.808 |
| 3,065,696 | 11/1962 | Kleinguenther | 244/3.23 |
| 3,195,406 | 7/1965 | Toomey | 89/1.819 |
| 3,251,267 | 5/1966 | Hauser | 244/3.23 |
| 3,427,921 | 2/1969 | Bode | 89/1.809 |
| 3,527,137 | 9/1970 | Scanlon | 89/1.816 |
| 4,194,706 | 3/1980 | Detalle | 244/3.23 |

FOREIGN PATENT DOCUMENTS

| | | | |
|---|---|---|---|
| 958943 | 5/1964 | United Kingdom | 89/1.819 |

*Primary Examiner*—Harold J. Tudor
*Assistant Examiner*—Edward F. Miles
*Attorney, Agent, or Firm*—Nathan Edelberg; Robert P. Gibson; Harold W. Hilton

[57] ABSTRACT

A spin device attached to the rocket nozzle to impart a relatively large amount of spin to the rocket in a short time while the rocket is guided in a tube launcher of a rearward facing step internal configuration. The device also acts as a rear shoe or sabot for the rocket. Upon contact with the rearward facing step, the spin device separates from the rocket. The forward rocket shoes leave the guidance of the forward tube at the same instant of device separation thus providing a nontip-off rocket launch.

2 Claims, 7 Drawing Figures

ROCKET IN-TUBE SPIN DEVICE AND REAR SABOT

DEDICATORY CLAUSE

The invention described herein may be manufactured, used, and licensed by or for the Government for governmental purposes without the payment to us of any royalties thereon.

BACKGROUND OF THE INVENTION

To date, spin devices have utilized the rocket exhaust gases of the motor via vanes or fins located in the divergent section of the nozzle near the nozzle exit plane. The rockets incorporating this type of spin device were spun to the required spin sometimes during the flight phase. The purpose of spinning a fin stabilized free flight rocket is to nullify thrust misalignment, assymetrical aerodynamic forces and to some extent to reduce mallaunch. A further reduction in these errors which cause dispersion can be obtained by a rocket which is spun to its maximum spin rate at launch. The torque impulse required to spin a rocket to 15 or 20 rps in a short guidance length can be obtained with this type of spin device.

The in-tube or during guidance spin device of the present invention utilizes the features of the basic flow from the nozzle through a reflected shock wave, i.e. the increase in pressure and the straightening of the flow, to extract the required torque impulse to spin a rocket at a predetermined rate of spin. (typically, 15 rps in 4 feet of rocket travel).

DESCRIPTION OF THE PREFERRED EMBODIMENT

Figure 1:
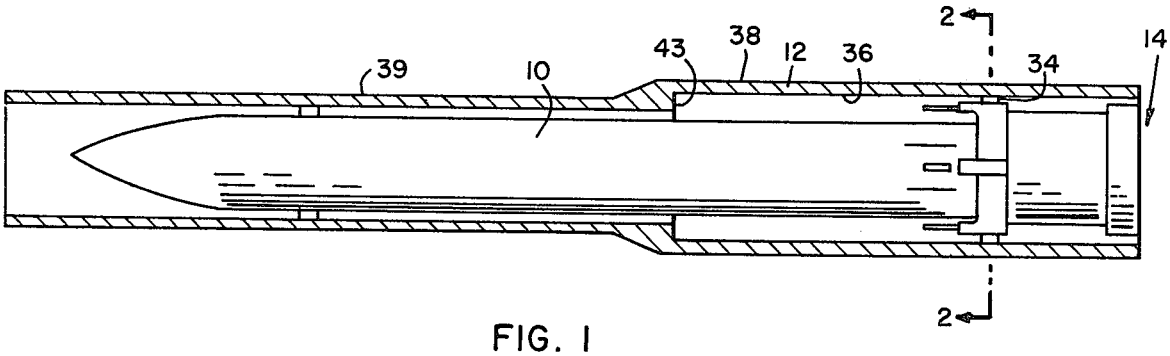
FIG. 1 is an elevational view having the launcher cut away to illustrate the rocket and spin device.
Figure 2:
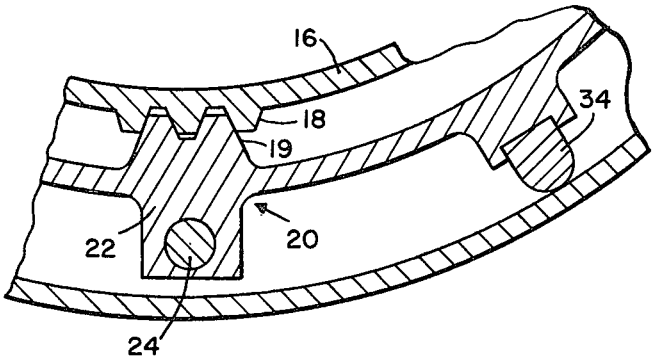
FIG. 2 is a partial sectional view taken along line 2—2 of FIG. 1.
Figure 3:
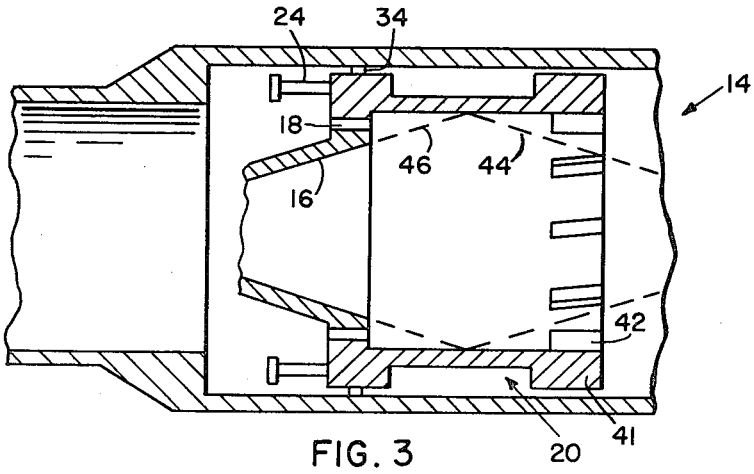
FIG. 3 is an enlarged sectional view of the launcher and spin device with the rocket moved forwardly in the launch tube.
Figure 4:
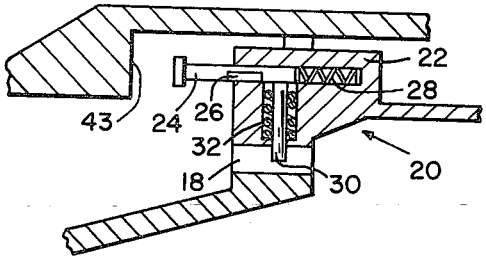
FIG. 4 is a partial elevational view of the rocket release mechanism.
Figure 5:
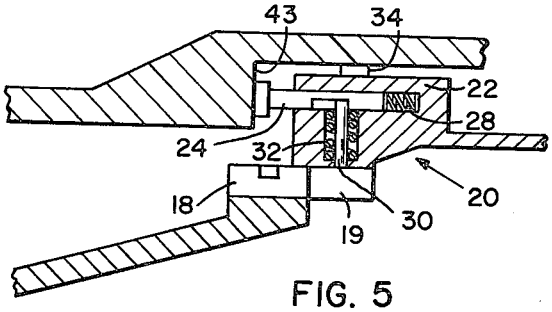
FIG. 5 is a partial elevational view of the release mechanism engaging the stepped surface of the launcher.

As shown in FIG. 1 a rocket 10 is disposed in a launcher 12 and is provided with a spin device 14 at the aft end thereof. As shown in FIG. 2 the spin device 14 is attached to the rocket nozzle 16 by a plurality of splines 18 and 19.

Splines 18 are on nozzle 16 and splines 19 are on spin device 14. The assembly consists of four groups of splines 18 spaced 90° apart and four groups of splines 19 spaced 90° apart.

The splines transfer torque to the rocket. FIGS. 3, 4, 5 and 6 illustrate a release mechanism 20 which provides a positive attachment to the nozzle during spin and also provides a means of separating the spin device from the rocket at the end of guidance. Four release mechanisms are provided, one adjacent each group of splines. Each mechanism 20 includes a housing 22 having a plunger 24 carried therein. The plunger is provided with a slot 26 thereon. A spring 28 is secured to the end of the plunger to bias the plunger in an extended position. A pin 30 is carried in housing 22 and a spring 32 is secured to pin 30 to bias the pin upwardly for sliding engagement with the plunger. Shoes 34 which bear on a guidance surface 36 are attached to the spin device so that the spin device acts as a rear sabot.

Figure 6:
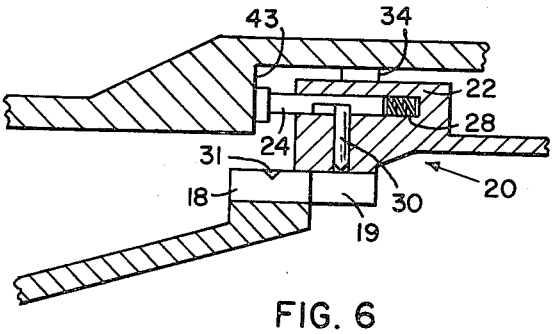
FIG. 6 is a view similar to FIG. 5 illustrating an alternate embodiment of the release mechanism.

If desired, as shown in FIG. 6, pin 30 may be tapered (hemispherical or conical) at the end 31 to fit in a slot in a similarly tapered slot in one of the splines.

Spin device 14 provides a means for launching a rocket in a nontip-off mode from launcher 12 which is comprised of two tubes 38 and 39 of different internal diameters with the small diameter tube forward a stepped surface 43 is between the two diameters. This type of launcher insures the reduction or elimination of mallaunch due to the interaction of the exhaust gases with the launcher and rocket.

Figure 7:
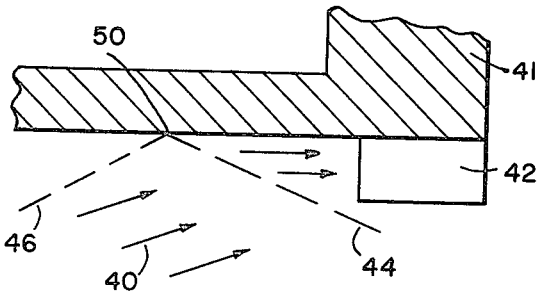
FIG. 7 is an enlarged partial view of the end of the spin device illustrating a spin vane thereon.

FIG. 7 is an enlarged partial view of the spin device having canted vanes 42 disposed around an internal tube 41.

The in-tube or during guidance spin device proposed utilizes the features of the basic flow 40 through a reflected shock 44 i.e. the increase in pressure and the straightening of the flow, to extract the required torque impulse to spin a rocket to 15 rps in 4 feet of rocket travel. The spin device consists of a large number of vanes 42 which are positioned around the internal circumference of a cylindrical tube 41. The tube is attached to the nozzle 16 via the splines and release mechanism. The rocket exhaust gases 40 expand from the nozzle exit and the jet boundary 46 impinges against the cylindrical tube 41. The gases 40 near the wall turn to flow parallel to the wall and the axis of the tube. Reflected shock 44 eminates from the impingement point or circle 50 processing the gases that flow past the vanes 42. The processing consists of reducing the mach number, increasing the pressure and temperature in the flow field and in inducing the flow near the wall to flow parallel with the wall. The vanes 42 are positioned aft of the reflected shock 44 at an angle of attack to the flow. Due to the increase in pressure in this region, the vanes 42 are able to extract larger amounts of force from the flow than if the flow was not processed through the shock. The larger force coupled with the fact that the vanes are positioned further from the nozzle axis produces the necessary torque impulse to spin a 250 pound rocket to 15 rps in 4 feet of rocket travel or guidance.

At the end of guidance the spin device is separated by the separation device plungers 24 engaging the step 43 presented by the smaller diameter forward tube. The rocket then free flies thru the forward tube. Upon separation the drag of the flow across the spin vanes slows the forward velocity of the spin device. The length of the plunger 24 can be varied so that the spin device decelerates to some nominal velocity before impact. The spin device impacts the step delivering an impulse to the launcher. The impulse is subjected to the launcher while the rocket is in free flight and is not a contributor to mallaunch or to launcher motion during guidance. This impulse is on the order of 1/10 of the impulse delivered to the launcher (while the rocket is being guided) by a rocket lug, helical rail launcher spin method.

Separation is accomplished when plunger 24 engages step 43 and is moved rearwardly to align groove 26 with pin 30 which is biased upwardly into the groove by spring 32 for release of the rocket. In the embodiment shown in FIG. 6, forward motion of the rocket forces the pin upwardly for separation.

We claim:

1. Apparatus for imparting spin to a rocket during launch thereof, said apparatus having sabot means carried thereby to guide said rocket in the launch tube comprising:

(a) Spin-up means including a cylindrical member secured to said rocket by splines on said rocket and said cylindrical member, said cylindrical member having a plurality of vanes disposed around the internal circumference of the aft end for impingement of rocket exhaust gases thereon for imparting rotation to said rocket;

(b) releasable attachment means for releasably securing said spin-up means to said rocket, said releasable attachment means disposed for engagement with an internal annular shoulder of said launcher for release of said spin-up means while said rocket is traversing said launcher; and, (c) sabot means secured to said cylindrical member for engagement with the internal surface of said launcher to guide said rocket in said launcher and to provide for non tip-off of said rocket, wherein said releasable attachment means includes a body having a plunger longitudinally disposed therein, said plunger having a slot on one side thereof, means for biasing said plunger in an extended position out of said body, a pin carried in said body normal to said plunger, means for biasing said pin against said plunger, said plunger disposed for engagement with said internal shoulder for displacement of said pin into said slot for release of said spin-up means and said rocket.

2. Apparatus for imparting spin to a rocket during launch thereof, said apparatus having sabot means carried thereby to guide said rocket in the launch tube comprising:

(a) spin-up means including a cylindrical member secured to said rocket by splines on said rocket and said cylindrical member, said cylindrical member having a plurality of vanes disposed around the internal circumference of the aft end for impingement of rocket exhaust gases thereon for imparting rotation to said rocket;

(b) releasable attachment means for releasably securing said spin-up means to said rocket, said releasable attachment means disposed for engagement with an internal annular shoulder of said launcher for release of said spin-up means while said rocket is traversing said launcher; and, (c) sabot means secured to said cylindrical member for engagement with the internal surface of said launcher to guide said rocket in said launcher and to provide for non tip-off of said rocket, wherein said releasable attachment means includes a body having a plunger longitudinally disposed therein, said plunger having a slot on one side thereof, means for biasing said plunger in an extended position out of said body, a pin carried in said body normal to said plunger, said pin having a tapered end, one of said splines having a tapered opening therein to receive said tapered end of said pin for securing said nozzle and cylindrical member.

* * * * *